US010847928B2

(12) United States Patent
Ostermann et al.

(10) Patent No.: US 10,847,928 B2
(45) Date of Patent: Nov. 24, 2020

(54) VIBRATION-ATTENTUATING CONNECTOR WITH AN OSCILLATION ABSORBER

(71) Applicant: TE Connectivity Germany GmbH, Bensheim (DE)

(72) Inventors: Ruediger Ostermann, Rimbach (DE); Ralf Hecker, Buerstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/246,622

(22) Filed: Jan. 14, 2019

(65) Prior Publication Data

US 2019/0148875 A1 May 16, 2019

Related U.S. Application Data

(63) Continuation of application No. PCT/EP2017/067698, filed on Jul. 13, 2017.

(30) Foreign Application Priority Data

Jul. 14, 2016 (DE) ..... 10 2016 212 923

(51) Int. Cl.
*H01R 13/52* (2006.01)
*H01R 13/533* (2006.01)
(Continued)

(52) U.S. Cl.
CPC ..... *H01R 13/5219* (2013.01); *H01R 13/502* (2013.01); *H01R 13/533* (2013.01); *H01R 13/5227* (2013.01); *H01R 13/6272* (2013.01)

(58) Field of Classification Search
CPC ..... H01R 13/5219; H01R 13/5227
See application file for complete search history.

(56) References Cited

U.S. PATENT DOCUMENTS 3,214,182 A * 10/1965 Herbruggen ..... F16J 15/32 277/465
4,456,320 A * 6/1984 Gallusser ..... H01R 13/5219 439/271

(Continued)

FOREIGN PATENT DOCUMENTS

CN 101517842 A 8/2009
CN 102106045 A 6/2011

(Continued)

OTHER PUBLICATIONS

PCT Notification of Transmittal, International Search Report and the Written Opinion of the International Searching Authority, International Application No. PCT/EP2017/067698, dated Oct. 20, 2017, 13 pages.

(Continued)

*Primary Examiner* — Tho D Ta

(57) ABSTRACT

A connector for plugging together with a counter-connector in a plug-in direction comprises a casing, a receptacle seal, and an oscillation absorber. The casing has a contact receptacle receiving a contact. The contact receptacle has a receptacle outer wall. The receptacle seal is disposed on the receptacle outer wall. The oscillation absorber is disposed at a distance from the receptacle seal in the plug-in direction and has a de-aeration opening extending through the oscillation absorber in the plug-in direction. A free volume extends between the receptacle seal and the oscillation absorber in the plug-in direction.

18 Claims, 3 Drawing Sheets

(51) Int. Cl.
*H01R 13/502* (2006.01)
*H01R 13/627* (2006.01)

(56) References Cited

U.S. PATENT DOCUMENTS

| | | | | | |
|---|---|---|---|---|---|
| 4,521,064 | A * | 6/1985 | Knapp | H01R 13/5219 | 439/153 |
| 5,334,032 | A * | 8/1994 | Myers | H01R 13/5219 | 439/140 |
| 5,356,304 | A * | 10/1994 | Colleran | H01R 13/5219 | 439/205 |
| 5,492,487 | A * | 2/1996 | Cairns | H01R 13/5219 | 439/271 |
| 5,618,201 | A | 4/1997 | Yagi et al. | | |
| 5,803,770 | A * | 9/1998 | Swendson | H01R 13/025 | 439/676 |
| 6,113,407 | A * | 9/2000 | Martin | H01R 13/521 | 439/205 |
| 6,478,619 | B1 * | 11/2002 | Wiechmann | H01R 13/533 | 439/587 |
| 7,572,135 | B2 | 8/2009 | Kozono | | |
| 8,029,310 | B2 | 10/2011 | Shindo | | |
| 8,491,323 | B2 * | 7/2013 | Ishibashi | H01R 13/5221 | 439/205 |
| 8,616,914 | B2 | 12/2013 | Mumper | | |
| 2003/0032321 | A1 * | 2/2003 | Wertz | H01R 13/5219 | 439/282 |
| 2011/0143566 | A1 | 6/2011 | Nakamura | | |
| 2015/0295343 | A1 | 10/2015 | Suzuki | | |

FOREIGN PATENT DOCUMENTS

| | | | | |
|---|---|---|---|---|
| CN | 104979680 | A | 10/2015 | |
| DE | 19743104 | A1 | 4/1999 | |
| EP | 1079472 | A1 * | 2/2001 | H01R 13/5208 |
| EP | 1764877 | B1 | 5/2008 | |
| EP | 2423534 | A2 | 2/2012 | |
| EP | 2701245 | A2 | 2/2014 | |
| EP | 2701245 | A3 | 2/2015 | |
| EP | 2423534 | A3 | 10/2017 | |
| JP | 2015-195125 | A | 11/2015 | |
| WO | 2015142094 | A1 | 9/2015 | |

OTHER PUBLICATIONS

First Chinese Office Action with English translation, Chinese Patent Application No. 201780043214.9, dated Sep. 27, 2019, 19 pages.
Abstract of JP 2015-195125 A, dated Nov. 5, 2015, 2 pages.
Second Chinese Office Action with English translation, Chinese Patent Application No. 201780043214.9, dated May 18, 2020, 14 pages.
Chinese Rejection Decision and English translation, dated Aug. 18, 2020, 13 pages.

* cited by examiner

VIBRATION-ATTENTUATING CONNECTOR WITH AN OSCILLATION ABSORBER

CROSS-REFERENCE TO RELATED APPLICATIONS

This application is a continuation of PCT International Application No. PCT/EP2017/067698, filed on Jul. 13, 2017, which claims priority under 35 U.S.C. § 119 to German Patent Application No. 102016212923.6, filed on Jul. 14, 2016.

FIELD OF THE INVENTION

The present invention relates to a connector and, more particularly, to a connector adapted to be plugged together with a counter-connector.

BACKGROUND

Electrical connectors are connected to a mating or counter-connector such that a contact disposed in a contact receptacle of the connector is connected to a contact of the counter-connector. When using the connector in a harsh environment, water or other substances may penetrate the connector and disrupt a plug-in connection. Mechanical shock or vibrations can also negatively affect the plug-in connection.

SUMMARY

A connector for plugging together with a counter-connector in a plug-in direction comprises a casing, a receptacle seal, and an oscillation absorber. The casing has a contact receptacle receiving a contact. The contact receptacle has a receptacle outer wall. The receptacle seal is disposed on the receptacle outer wall. The oscillation absorber is disposed at a distance from the receptacle seal in the plug-in direction and has a de-aeration opening extending through the oscillation absorber in the plug-in direction. A free volume extends between the receptacle seal and the oscillation absorber in the plug-in direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
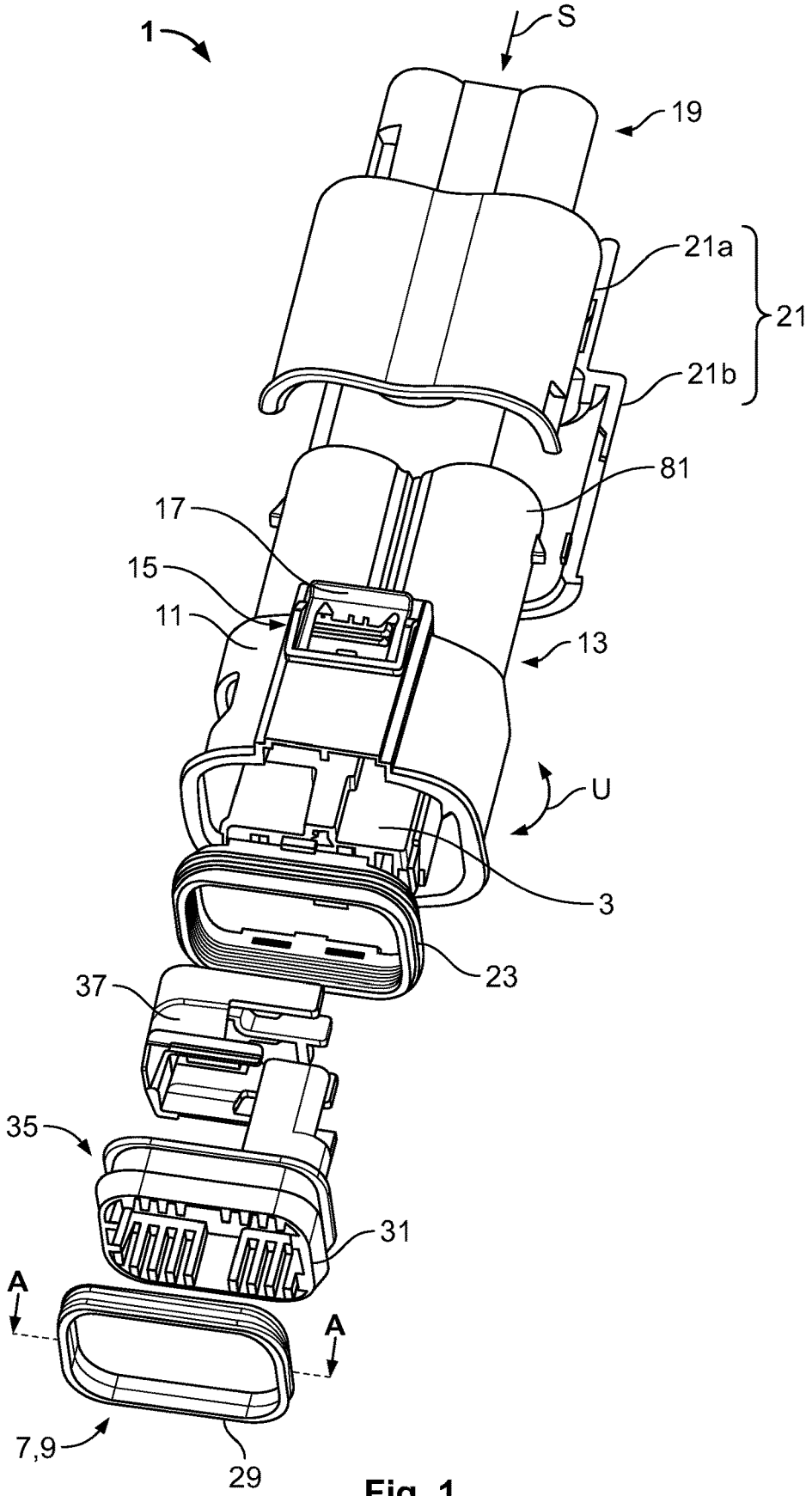
FIG. 1 is an exploded perspective view of a connector according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art.

Figure 2:
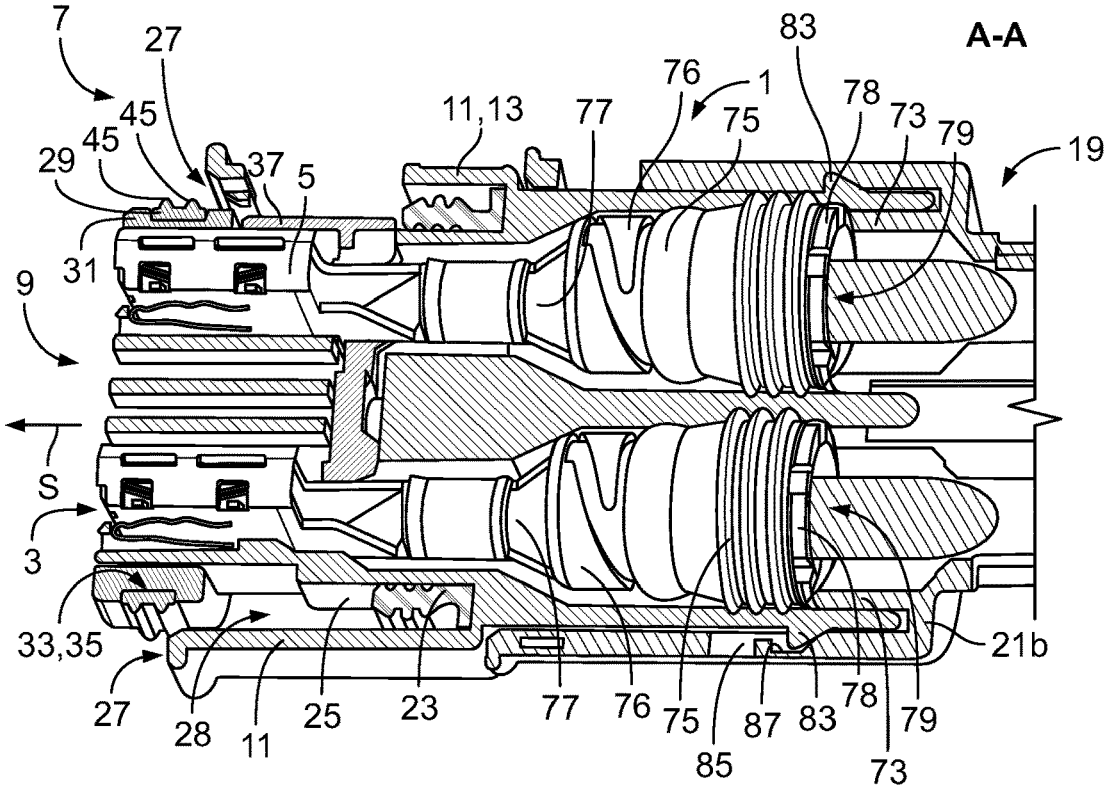
FIG. 2 is a sectional top view of the connector with contacts disposed in the connector.

A connector 1 according to an embodiment is shown in FIGS. 1 and 2. The connector 1 extends along a plug-in direction S and is configured to be connected to a counter-connector (not shown) along the plug-in direction S. The connector 1 has a contact receptacle 3 into which a plurality of contacts 5 can be inserted. FIG. 2 shows, by way of example, two contacts 5 inserted in the contact receptacle 3. The contact receptacle 3 is accessible from a front side 7 of the connector 1 in the plug-in direction S, and thereby forms a connector face 9.

The contact receptacle 3 is surrounded in a peripheral direction U by a casing outer wall 11 of the connector 1, as shown in FIGS. 1 and 2. In an embodiment, the casing outer wall 11 is formed monolithically with the contact receptacle 3. The peripheral direction U runs around the plug-in direction S. The contact receptacle 3 and the casing outer wall 11 together form a casing 13 of the connector 1. A securing receptacle 15 for a position-securing element 17 is disposed in the casing outer wall 11. The position-securing element 17 can be inserted into the securing receptacle 15 substantially parallel to the plug-in direction S.

As shown in FIG. 1, the connector 1 has a two-part cover 21 at the rear side 19 opposite the connector face 9 in the plug-in direction S. The cover 21 surrounds the casing 13 at least in portions when the two halves 21*a* and 21*b* of the cover 21 are assembled and attached to the casing 13.

A receptacle seal 23, as shown in FIGS. 1 and 2, is arranged between the contact receptacle 3 and the casing outer wall 11. The receptacle seal 23 abuts and is disposed on a receptacle outer wall 25 of the contact receptacle 3. A counter-connector receptacle 27 receiving at least one part of the counter-connector is accessible from the front side 7 and extends in the plug-in direction S between the contact receptacle 3, or rather the receptacle outer wall 25 thereof, and the casing outer wall 11. The counter-connector receptacle 27 extends up into a region between the receptacle seal 23 and the casing outer wall 11. The receptacle seal 23 and the counter-connector receptacle 27 are continuous in the peripheral direction U. In a state plugged together with a counter-connector, one part of the counter-connector is arranged in the counter-connector receptacle 27 in such a way that it is in continuous contact with the receptacle seal 23 in the peripheral direction U. At the same time, the counter-connector encloses the region of the contact receptacle 3 between the receptacle seal 23 and the connector face 9. The contact receptacle 3 is thus outwardly sealed from ingress of liquid or dirt.

An oscillation absorber 29 is attached to the front side 7 as shown in FIGS. 1 and 2. The oscillation absorber 29 extends in the peripheral direction U about the contact receptacle 3 or connector face 9. The oscillation absorber 29 is continuous in the peripheral direction U. A free volume 28, which is open towards the counter-connector receptacle 27 or which coincides therewith at least in portions, extends between the oscillation absorber 29 and the receptacle seal 23. The oscillation absorber 29 is arranged on a holder 31 which surrounds the contact receptacle 3 in the peripheral direction U. In order to prevent slipping of the oscillation absorber 29 from the holder 31, the holder 31 has a seat 35 for the oscillation absorber 29 which is formed as a groove 33 running in the peripheral direction U—or transverse to the plug-in direction S in a circumferential manner. In an embodiment, the oscillation absorber 29 is formed of a different material than the receptacle seal 23, and is more rigid than the receptacle seal 23. In an embodiment, the oscillation absorber 29 is formed of a silicone material.

The holder 31, as shown in FIGS. 1 and 2, terminates flush with the front side 7 or connector face 9. The holder 31 can protrude into the counter-connector receptacle 27 in the plug-in direction S, at least to a certain extent. In another embodiment, the oscillation absorber 29 may be arranged in the counter-connector receptacle 27 at least in portions. In another embodiment, the oscillation absorber 29 may be directly attached to the receptacle outer wall 25.

In a plugged-together state, the counter-connector is arranged, at least in portions, between the casing outer wall 11 and the oscillation absorber 29 of the connector 1. The oscillation absorber 29 abuts the counter-connector continuously in the peripheral direction U. The oscillation absorber 29 abuts the counter-connector or the part of the counter-connector like a seal, as described in greater detail below with reference to FIGS. 3 and 4.

The connector 1, as shown in FIG. 1, has a spacer 37 arranged behind the holder 31 of the oscillation absorber 29 in an assembled state, starting from the connector face 9 when viewed in the plug-in direction S. The spacer 37 positions the holder 31 and the contacts 5.

The oscillation absorber 29 and the holder 31 will now be described in greater detail with reference to FIGS. 3 and 4.

Figure 4:
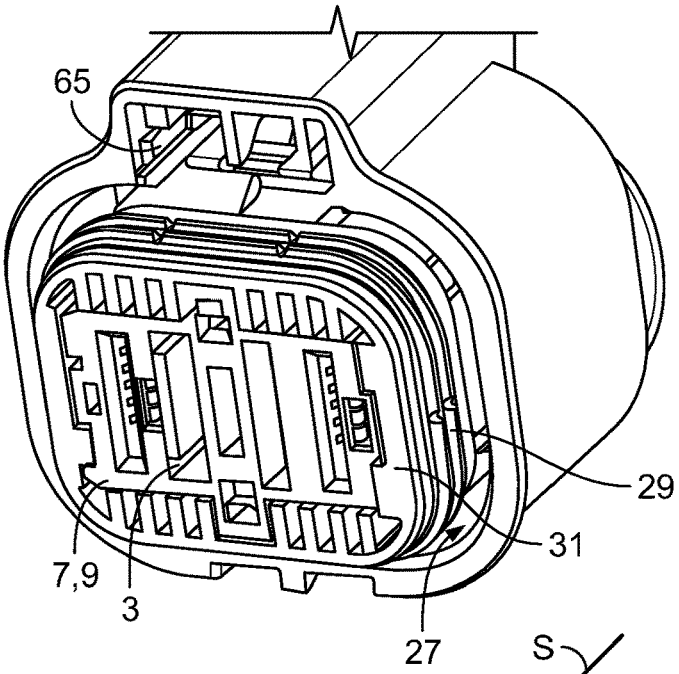
FIG. 4 is a perspective view of the holder and the oscillation absorber in a state of insertion in the connector.

The holder 31 and the oscillation absorber 29 are each formed continuously in the peripheral direction U, and can surround the contact receptacle 3 in a mounted state as shown in FIG. 4. In an embodiment, the holder 31 is formed of a material which is more rigid than the material of the oscillation absorber 29. The holder 31 has catching elements 39 which extend in the plug-in direction S from the connector face 9 in the direction of the rear side 19 and which lock with the casing 13 or the contact receptacle 3. The holder 31 has a grooved structure which is formed by grooves 41 and the ribs 43 which form the grooves 41 between them. The grooved structure can save material and weight for the holder 31. The grooves 41 run parallel to the plug-in direction S and are closed on the rear side of the holder 31.

Figure 3:
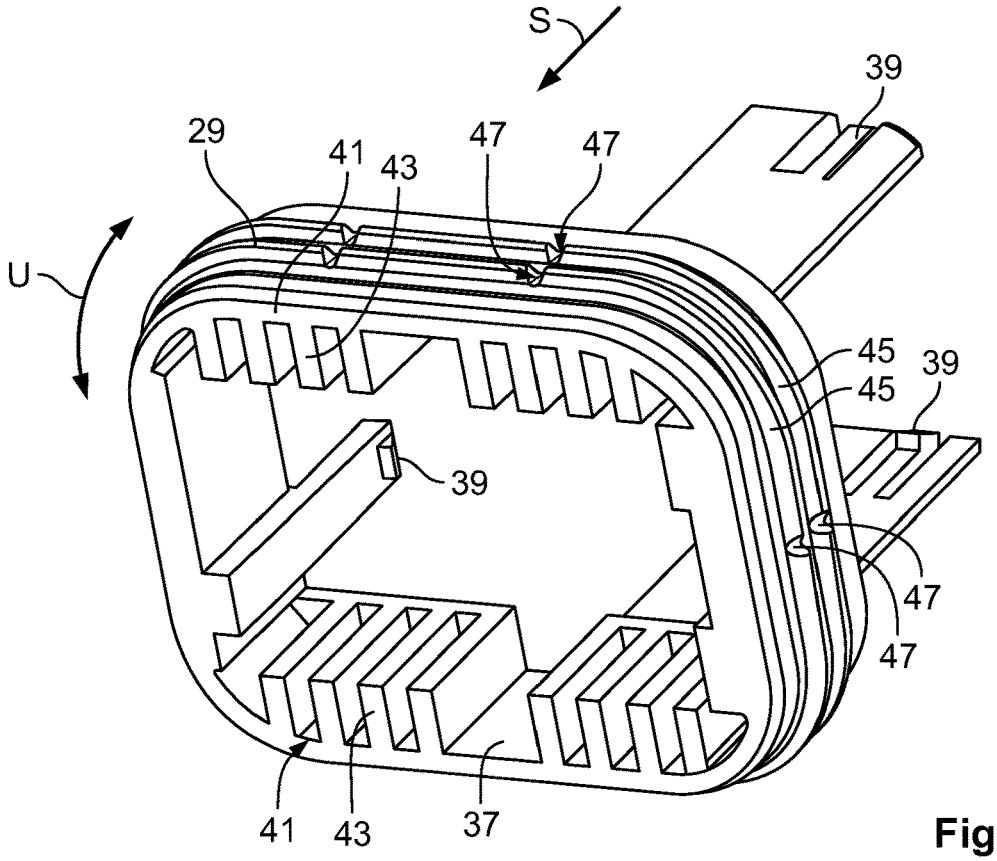
FIG. 3 is a perspective view of a holder and an oscillation absorber of the connector.

The oscillation absorber 29, as shown in FIG. 3, has two circumferential ribs 45 in the peripheral direction U which are formed monolithically with the rest of the oscillation absorber 29. The two ribs 45 are arranged one behind the other when viewed in the plug-in direction S. The ribs 45 abut the counter-connector in a state of connection to a counter-connector.

The oscillation absorber 29 has a plurality of de-aeration openings 47 shown in FIG. 3 that extend into the ribs 45, such that the ribs 45 are interrupted in places by the de-aeration openings 47. Each of the ribs 45 has a series of de-aeration openings 47 circumferentially in the peripheral direction U, wherein the de-aeration openings 47 of the two ribs 45 are arranged one behind the other in the plug-in direction S, such that an airflow running in the plug-in direction S can pass through the de-aeration openings 47 unhindered. When plugging together with a counter-connector, the de-aeration openings 47 serve to let air escape from the inside of the connector 1, in particular from the free volume 28, so that plugging is not hindered. The oscillation-absorbing function of the oscillation absorber 29 is not impaired by the de-aeration openings 47.

Figure 5:
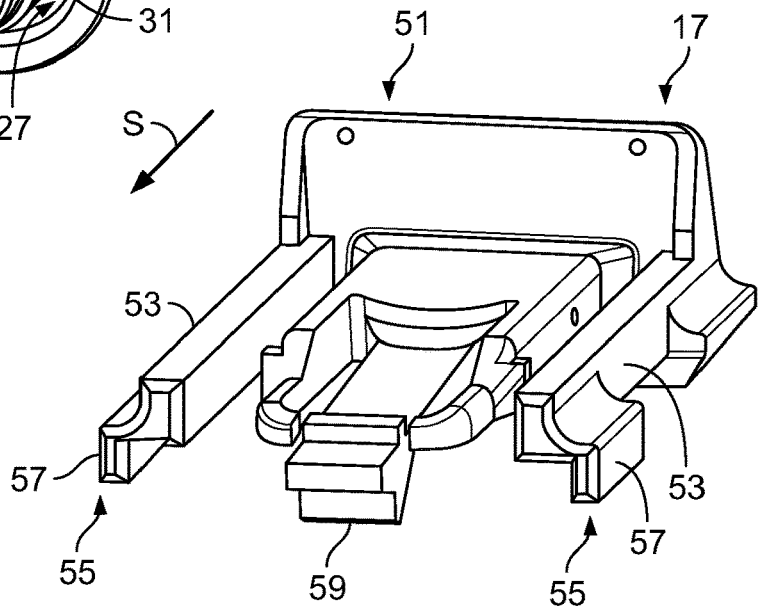
FIG. 5 is a perspective view of a position-securing element.
Figure 6:
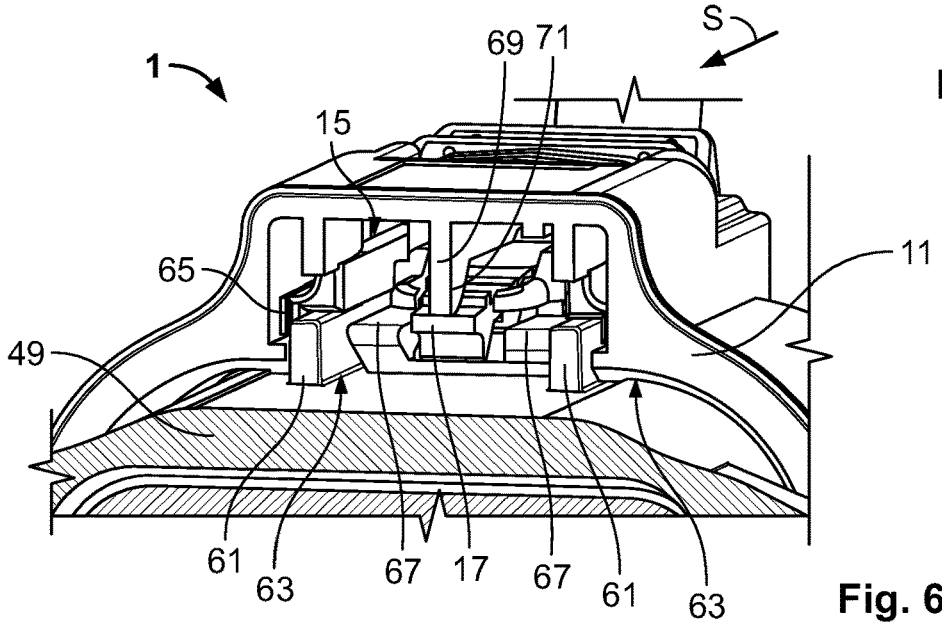
FIG. 6 is a perspective view of the position-securing element in a state of insertion in a securing receptacle of the connector.

The position-securing element 17 is shown in FIG. 5 and is shown in the receptacle in FIG. 6. The position-securing element 17 can be inserted into the securing receptacle 15 along the plug-in direction S and secures a counter-connector 49 connected to the connector 1, an upper part of the counter-connector 49 being shown in FIG. 6.

The position-securing element 17, as shown in FIGS. 5 and 6, extends along the plug-in direction S. The position-securing element 17 has an actuation portion 51 which points in the direction of the rear side 19 of the connector 1 when the position-securing element 17 is arranged in the securing receptacle 15. From the actuation portion 51, two arms 53 extend in the plug-in direction S. The arms 53 each have a bracket 57 at their free ends 55. The brackets 57 are offset outwards from the arms 53 in the peripheral direction U from the position-securing element 17, and extend outwards from the arms 53 in the direction of the contact receptacle 3 when the position-securing element 17 is arranged in the securing receptacle 15. The position-securing element 17 has a locking element 59 which can be deflected in the direction of the contact receptacle 3 in order to hold the counter-connector 49 on the connector 1.

As shown in FIG. 6, the securing receptacle 15 is formed in the casing outer wall 11. The outer wall 11 is open towards the contact receptacle 3 in order to receive ribs 61 of the counter-connector 49. The outer wall 11 is open by slots 63 which run substantially parallel to the plug-in direction S.

Two wedges 65 opposite each other in the peripheral direction U are arranged in the securing receptacle 15, as shown in FIG. 6. The wedges 65 are formed monolithically with the casing outer wall 11. The wedges 65 extend in the plug-in direction S and are wider towards the connector face 9. In doing so, the wedges 65 each widen in the direction of the opposite wedge 65 and consequently, in the region of the wedges 65, the securing receptacle 15 becomes narrower from the rear side 19 towards the connector face 9. Each wedge 65 is associated with an opposite shoulder 67, such that in each case a slot 63 is arranged between a shoulder 67 and a wedge 65. The shoulders 67 support the ribs 61 of the counter-connector 49.

If the counter-connector 49 is connected to the connector 1, the position-securing element 17 can be inserted into the securing receptacle 15 along the plug-in direction S. The position-securing element 17 is moved, coming from the rear side 19, towards the connector face 9. At the same time, the brackets 57 move along the wedges 65. The brackets 57 are moved towards each other by the wedge 65 shape, and in the process, they push on the ribs 61 of the counter-connector 49 and press them against the shoulders 67. The ribs 61 are thus jammed in the securing receptacle 15 and a movement in the peripheral direction of the counter-connector 49 is prevented. An additional vibration protection can be formed by this step. At the same time, the locking element 59 is pushed in the direction of the counter-connector 49 by a securing element 69 located in the securing receptacle 15. When the position-securing element 17 is inserted into the securing receptacle 15, the locking element 59 slides along a leading slope 71 of the securing element 69 and is thereby deflected in the direction of the contact receptacle 3.

The connector 1, as shown in FIG. 2, has a pair of support members 73 on the rear side 19 of the connector 1 opposite the connector face 9. The support members 73 support contact seals 75 arranged between the connector face 9 and the support members 73. Pressure is applied on the contact seals 75 and they are pressed together by the support members 73. The contact seals 75 are held by retaining clips 76 of the contacts 5 on the ends of the contact seals 75 pointing towards the connector face 9. The contact seals 75 are thus clamped between the casing 13 and the support members 73.

The support members 73, as shown in FIG. 2, are substantially sleeve-shaped so that a pressure, which is uniform in the peripheral direction U, can be exerted onto the contact seals 75. In order to distribute the pressure uniformly onto the contact seals 75, and in order to prevent slipping of the rubber-elastic contact seals 75 from the support members 73, disc-shaped pressure distribution elements 78 are arranged between the support members 73 and the contact seals 75. The pressure distribution elements 78 are able to distribute the pressure of the support members 73 uniformly onto the contact seals 75.

In an embodiment, the support members 73 are formed monolithically with the two-part cover 21. In this case, each half 21*a* and 21*b* of the two-part cover 21 can have one part of the support members 73. The cover 21 is locked with the rear end 81 of the casing 13. The casing 13 has locking catches 83 which extend away from the casing 13 transverse to the plug-in direction S and lock with the cover 21. As shown in FIG. 2, for each locking catch 83, the cover 21 has a first locking catch receptacle 85 and a second locking catch receptacle 87. The first locking catch receptacle 85 defines a reserve position of the cover 21 on the casing 13. The second locking catch receptacle 87 defines an end position of the cover 21 on the casing. The locking catch receptacles 85 and 87 can be present in the two halves 21*a* and 21*b* of the cover 21 or only in one of the two halves 21*a*, 21*b*.

For mounting, the half 21*b* of the cover 21 is first placed on the casing 13 until the locking catches 83 are arranged in the two first locking catch receptacles 85. The support members 73 or the parts of the support members 73, which are equally distributed on the two halves 21*a* and 21*b* of the cover, also penetrate the casing 13. Next, the second half 21*a* of the cover 21 is connected to the half 21*b*, and the assembled cover 21 is further moved in the plug-in direction S until the locking catches 83 are arranged in the second locking catch receptacles 87. The end position for the cover 21 is then reached. In the end position, the support members 73 push against the pressure distribution element 78.

Due to the clamping or pressing together, the contact seals 75 cannot move freely, and also serve a vibration-attenuating purpose for the connector 1. The pressing together of the contact seals 75 in the plug-in direction S can lead to the seals 78, which are formed of an elastically deformable material, widening transverse to the plug-in direction S and pressing against the casing 13, whereby vibrations of the casing 13 can also be absorbed. In an embodiment, the contact seals 75 are arranged around cables 77 which lead to the contacts 5. The cables 77 thus run through the contact seals 75. Likewise, the support members 73 have cable ducts 79 which are formed by openings in the support members 73. The support members 73 thus surround the cables 77 transverse to the plug-in direction S.

What is claimed is:

1. A connector for plugging together with a counter-connector in a plug-in direction, comprising:

a casing having a contact receptacle receiving a contact, the contact receptacle having a receptacle outer wall;

a receptacle seal disposed on the receptacle outer wall; and an oscillation absorber disposed at a distance from the receptacle seal in the plug-in direction and having a de-aeration opening defined by and extending through the oscillation absorber in the plug-in direction, a free volume extending between the receptacle seal and the oscillation absorber in the plug-in direction.

2. The connector of claim 1, wherein the oscillation absorber surrounds the contact receptacle in a direction transverse to the plug-in direction.

3. The connector of claim 1, wherein the oscillation absorber is formed of a different material than the receptacle seal.

4. The connector of claim 1, further comprising a support member on a rear side of the connector opposite a connector face.

5. The connector of claim 1, wherein the oscillation absorber has a circumferential rib extending in a peripheral direction.

6. The connector of claim 5, wherein the circumferential rib is interrupted by the de-aeration opening in the peripheral direction.

7. The connector of claim 1, further comprising a holder on which the oscillation absorber is disposed.

8. The connector of claim 7, wherein the holder is disposed between the receptacle outer wall and the oscillation absorber.

9. The connector of claim 1, wherein the casing has a casing outer wall with a securing receptacle receiving a position-securing element to secure a counter-connector.

10. The connector of claim 9, wherein the casing outer wall is open in a region of the securing receptacle in a direction toward the contact receptacle and receives a part of the counter-connector.

11. A connector for plugging together with a counter-connector in a plug-in direction, comprising:

a casing having:

a contact receptacle receiving a contact, the contact receptacle having a receptacle outer wall; and a casing outer wall with a securing receptacle receiving a position-securing element to secure a counter-connector, a wedge is disposed in the securing receptacle, the wedge widens in the plug-in direction toward a connector face of the connector;

a receptacle seal disposed on the receptacle outer wall; and an oscillation absorber disposed at a distance from the receptacle seal in the plug-in direction and having a de-aeration opening extending through the oscillation absorber in the plug-in direction, a free volume extending between the receptacle seal and the oscillation absorber in the plug-in direction.

12. The connector of claim 11, wherein the securing receptacle has a shoulder opposite the wedge in a peripheral direction.

13. The connector of claim 11, wherein the securing receptacle has a pair of wedges disposed opposite each other in a peripheral direction.

14. The connector of claim 11, wherein the position-securing element has a bracket abutting the wedge in an inserted state of the position-securing element in the securing receptacle.

15. The connector of claim 14, wherein the bracket is deformable in a peripheral direction.

16. A connector for plugging together with a counter-connector in a plug-in direction, comprising:

a casing having a contact receptacle receiving a contact, the contact receptacle having a receptacle outer wall;

a receptacle seal disposed on the receptacle outer wall;

a support member on a rear side of the connector opposite a connector face, the support member supports a contact seal disposed between the support member and the connector face; and an oscillation absorber disposed at a distance from the receptacle seal in the plug-in direction and having a de-aeration opening extending through the oscillation absorber in the plug-in direction, a free volume extending between the receptacle seal and the oscillation absorber in the plug-in direction.

17. The connector of claim 16, wherein the support member surrounds a cable duct transverse to the plug-in direction.

18. A connector arrangement, comprising:

a connector including a casing having a contact receptacle receiving a contact, the contact receptacle having a receptacle outer wall, a receptacle seal disposed on the receptacle outer wall, and an oscillation absorber disposed at a distance from the receptacle seal in a plug-in direction and having a de-aeration opening extending through the oscillation absorber in the plug-in direction, a free volume extending between the receptacle seal and the oscillation absorber in the plug-in direction; and a counter-connector having a sealing surface abutting the receptacle seal and the oscillation absorber in a plugged state in which the connector is plugged together with the counter-connector in the plug-in direction.

* * * * *